United States Patent [19]

Daniel

[11] Patent Number: 4,919,894

[45] Date of Patent: Apr. 24, 1990

[54] MULTIPLE SAMPLE HOLDER INDEXING MEANS AND METHOD OF USING SAME

[76] Inventor: Robert Daniel, 805 NW. Greenwood, Ankeny, Iowa 50021

[21] Appl. No.: 197,619

[22] Filed: May 23, 1988

[51] Int. Cl.[5] ..... B01C 9/00

[52] U.S. Cl. ..... 422/104; 422/99; 422/102

[58] Field of Search ..... 422/102, 104, 73, 99; 220/345, 356; 206/569

[56] References Cited

U.S. PATENT DOCUMENTS

| | | | |
|---|---|---|---|
| 2,412,332 | 12/1946 | Hansen . | |
| 2,473,532 | 6/1949 | Lazare | 220/345 |
| 2,549,013 | 4/1951 | Robles et al. | 220/345 |
| 3,184,071 | 5/1965 | Delaire | 220/345 |
| 3,378,347 | 4/1968 | Saravis . | |
| 3,480,400 | 11/1969 | Csizmas et al. . | |
| 3,674,438 | 7/1972 | Shen . | |
| 3,884,641 | 5/1975 | Kraffczyk et al. . | |
| 4,090,850 | 5/1978 | Chen et al. . | |
| 4,178,345 | 12/1979 | Terk . | |
| 4,195,060 | 4/1980 | Terk . | |
| 4,284,725 | 8/1981 | Fennel, III et al. | 435/301 |
| 4,333,567 | 6/1982 | Leonard . | |
| 4,564,503 | 1/1986 | Greisch . | |
| 4,636,477 | 1/1987 | Ronka et al. . | |
| 4,682,891 | 7/1987 | DeMacario et al. . | |
| 4,704,255 | 11/1987 | Jolley . | |

FOREIGN PATENT DOCUMENTS

| | | | |
|---|---|---|---|
| 211729 | 10/1960 | Austria | 220/345 |

OTHER PUBLICATIONS

"Minifold Micro-Sample Filtration Method"; Brochure from Schleicher & Schuell, Inc.; copyright 1981.

*Primary Examiner*—Christine M. Nucker
*Assistant Examiner*—D. John Griffith, Jr.
*Attorney, Agent, or Firm*—Zarley, McKee, Thomte, Voorhees & Sease

[57] ABSTRACT

An indexing method and means for a sample support having multiple sample holders organized in rows and columns is disclosed. A cover with an opening therein slides over sidewalls surrounding at least part of the sample support. This covers a portion of the holders while allowing access to another portion. Stepped edges may be also provided to support multiple sample supports. Another embodiment provides symbols along one sidewall abutting the sample support and a second set of symbols along a guide member slidable over the sample support. These symbols are aligned with rows and columns of the sample support providing for indexing of any one sample holder. This device and method may be combined with a second component for second sample support having matching symbols, allowing for cross-indexing of the sample holders to one another.

5 Claims, 3 Drawing Sheets

MULTIPLE SAMPLE HOLDER INDEXING MEANS AND METHOD OF USING SAME

BACKGROUND OF THE INVENTION

When conducting lab tests, a commonly used device is a sample support with multiple holders within it to hold a sample being tested. A rack of test tubes may support samples waiting to be tested or transferred, and a microtiter plate is often used for testing. This plate consists of a series of microwell holes in plate, with the holes being arranged in rows or columns.

To conduct any one of a number of tests utilizing the microtiter plate, it is necessary to use a pipette to provide material to each one of the individual microwells. Since a typical plate contains $8 \times 12$ horizontal and vertical rows, placing the material into the 96 individual microwells requires considerable care and deliberation. Certain tests may also require that different substances be placed in different microwells, further complicating the procedure. When different substances are being placed in different microwells, the possibility of cross-contamination between the microwells exists. Further, the exposure of the plate to the open air increases the likelihood of contaminants entering the microwells.

Additionally, it is often necessary for lab personnel to be able to determine which of the microwells have had the necessary substance transported to it, and which remain to be so inoculated. This is especially true when the laboratory personnel working with the plate must transport fluid samples from different identified sources to identified well holes in the microtiter plate, such as when a substance is removed from a tube in the test tube rack and placed in a microwell. Accuracy in transporting the sample from the properly identified source to the appropriate well is critical. If the sample is placed in the improper well, the identity of the sample is confused and permanently lost and the test results will be false. Therefore, accuracy is crucial. In a laboratory setting, personnel are at times distracted or must leave their work stations when they are in the midst of manually transporting samples to the microtitration plate. Also, the lab technician needs to be able to match the source of inoculant with the particular well hole to which it is to be transported.

This invention addresses these problems in the prior art by reducing cross-contamination and improving accuracy.

SUMMARY OF THE INVENTION

This invention relates to a means which reduces cross-contamination, and contamination from exposure of a microtiter plate to the air by providing for a base plate in which the microtiter plate sits, and a cover which may slide over the microtiter plate. The cover is provided with an opening in the top which allows selective exposure of a portion of the microwells, while covering the remaining microwells. This assists in keeping track of which row is being inoculated, while at the same time reducing the chance of cross-contamination and contamination from the air.

The device can optionally provide for stepped supports within the base plate, which allow for different sized microtiter plates to be used, and further allows for the possibility that a single plate may optionally be placed in one of two axes on the base plate which are perpendicular to one another.

Yet another embodiment provides for a guide member which may be a sliding cover, in connection with a side member, associated with a sample support having multiple sample holders therein arranged in rows and columns. The side member can be a sidewall which may be connected to a second sidewall. The device includes symbols along the top of the side member, with one symbol for each row of the sample holder, and a different set of symbols across the top of the sliding guide member, providing for a different symbol for each of the columns. By indexing the guide member symbols and the side member symbols, any one of the sample holders may be specifically identified. Thus, a microtiter plate placed in this device may be indexed to any of its microwells.

Similarly, this device may be used to index a test tube rack or the like. Further, cross-indexing is accomplished when a microtiter plate is placed in one such device and a test tube rack placed in a second device. When the guide members of the devices have matching symbols and the side members of the devices likewise have matching symbols, any one of the test tubes may be cross-indexed to the corresponding microwell.

Accordingly, it is an object of this invention to improve in the disadvantages of prior art.

It is a further object of this invention to provide for an indexing means and method for a sample supporter having multiple sample holders.

Another object of the invention is to provide for a means and method of reducing cross-contamination between multiple sample holders.

Yet another object of the invention is to provide for reduced contamination by preventing material in the air from entering the sample holders.

A further object of the invention is to provide for a means to selectively expose a portion of sample holders while covering the remaining sample holders.

Still another object of the invention is to provide for a visible means of detecting which row the lab technician is working on.

Another object of the invention is to provide for an indexing means and method in which symbols are used to identify each of the rows, and each of the columns of a sample holder so that any particular holder may be identified by cross-indexing of the symbols.

A further object is to provide for such an indexing means and method in which a cover containing the symbols for the columns may slide over the microtiter plate.

Yet another object is to provide for a cross-indexing means involving a symbol for each of the rows and symbols for each of the columns of a sample support holder which match the corresponding rows and columns of the symbols for another sample holder, in order that the first sample holder may be matched to its corresponding second sample holder.

Another object of the invention is to provide for supports within the indexing means which are capable of supporting different sized microtiter plates.

A further object is to provide for supports capable of supporting more than one microtiter plate therein.

It is another object to provide for supports capable of supporting a microtiter plate in different orientations on an indexing means.

A still further object is to provide for an indexing means which is inexpensive to produce.

BRIEF DESCRIPTION OF THE DRAWINGS

FIG. 9 is a top view of the second embodiment of this invention.

DETAILED DESCRIPTION OF THE INVENTION

Figure 6:
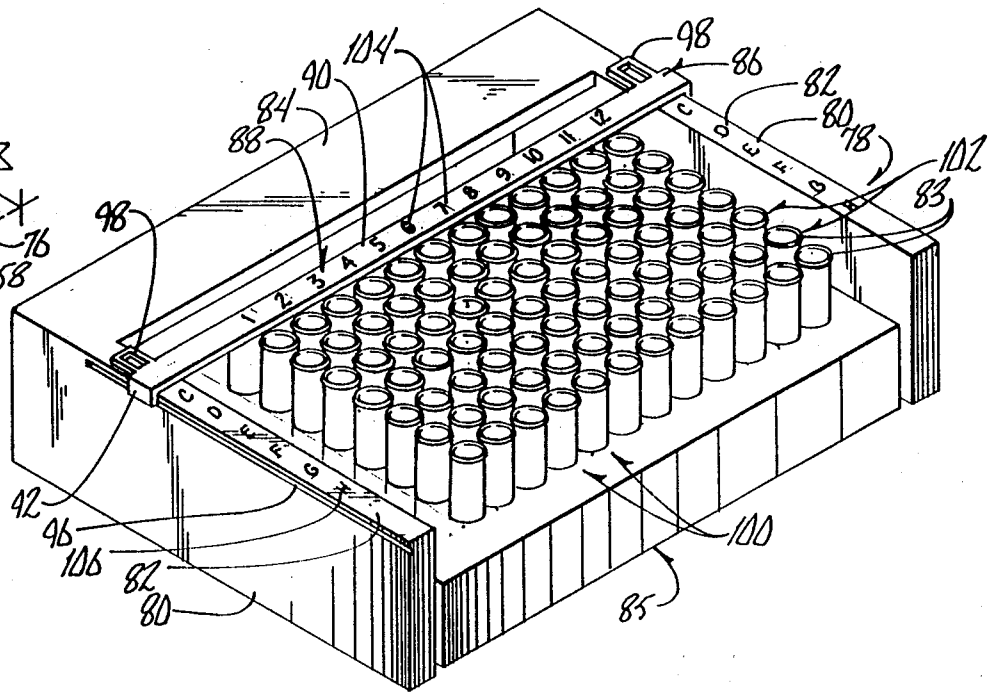
FIG. 6 is a top plan view of a device optionally used with the first or second embodiment.
Figure 5:
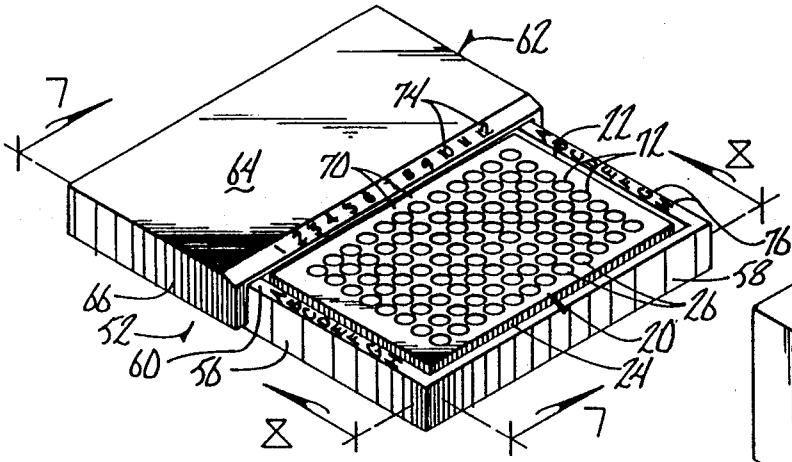
FIG. 5 is a perspective view of a second embodiment showing the device of this invention.
Figure 7:
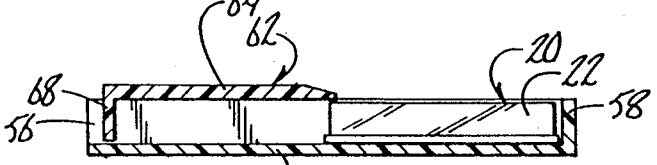
FIG. 7 is a cross-sectional view taken along line 7—7 of FIG. 5.
Figure 10:
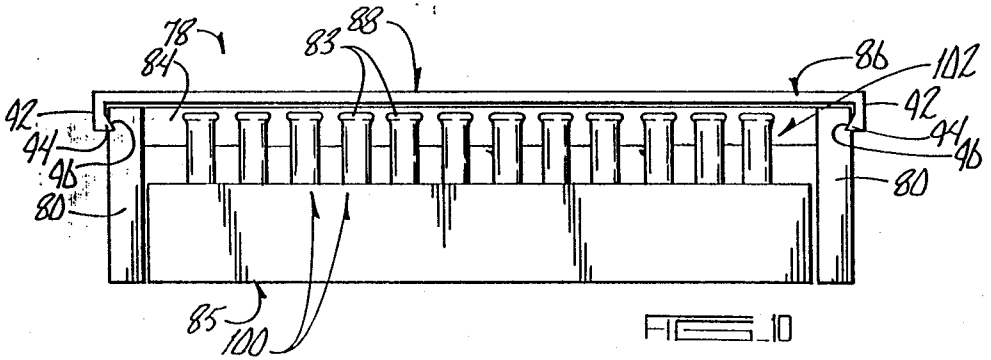
FIG. 10 is a front elevational view of the device of FIG. 6 optionally used with the first or second embodiment.
Figure 8:
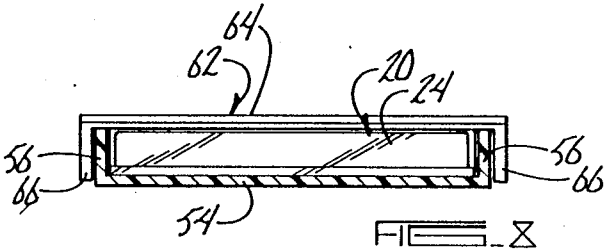
FIG. 8 is a cross-sectional view taken along line 8—8 of FIG. 5.
Figures 6, 7, 11:
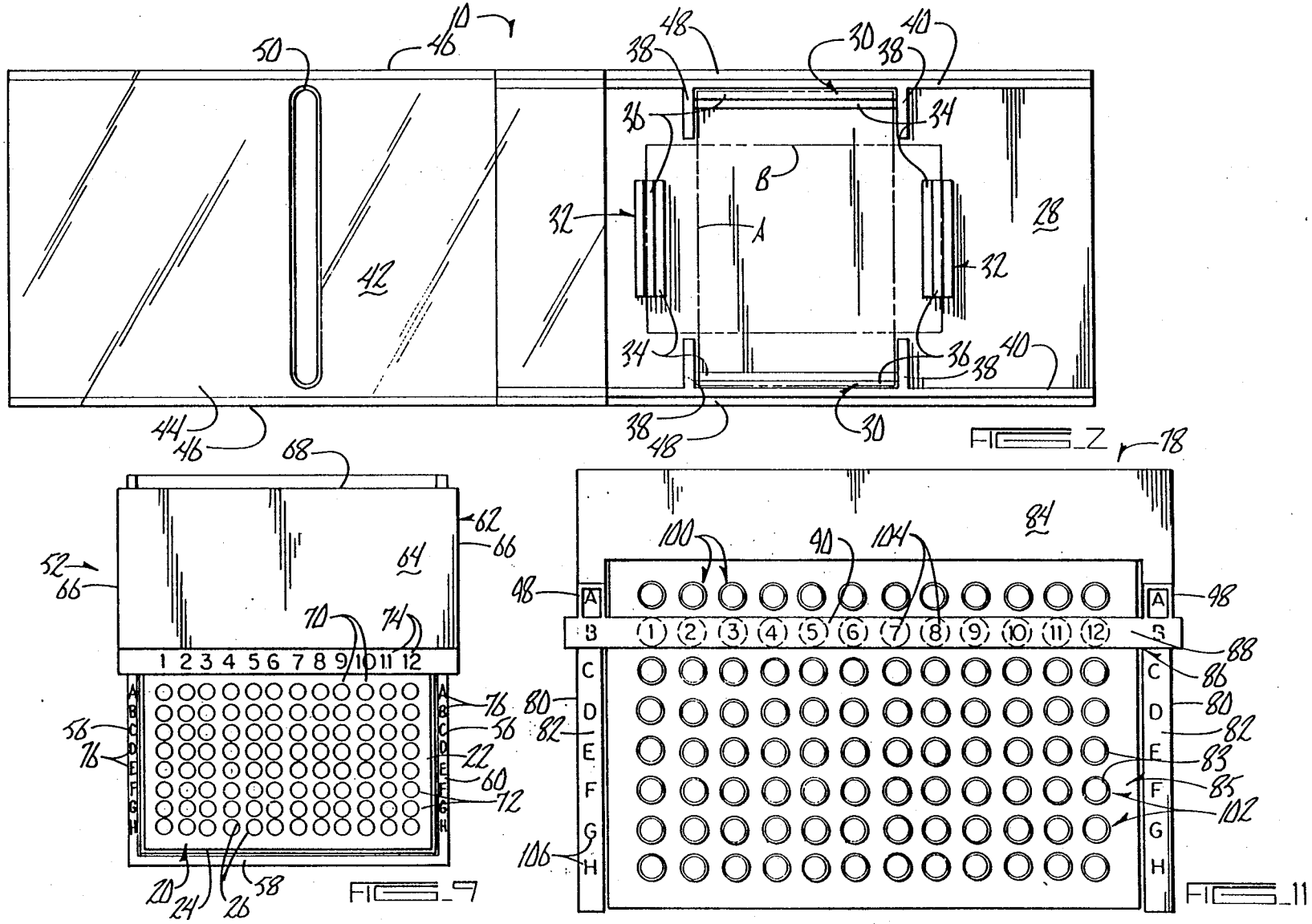
FIG. 11 is a top view of the optional device of FIG. 6 which may be included in the first or second embodiment of this invention.

FIGS. 1 through 4 represent a first embodiment of this invention, while FIGS. 5 through 11 represent a second embodiment of this invention. FIGS. 6, 10 and 11 show that aspect of the second embodiment which may optionally be used with the first or second embodiment.

Figures 1, 2, 3, 4:
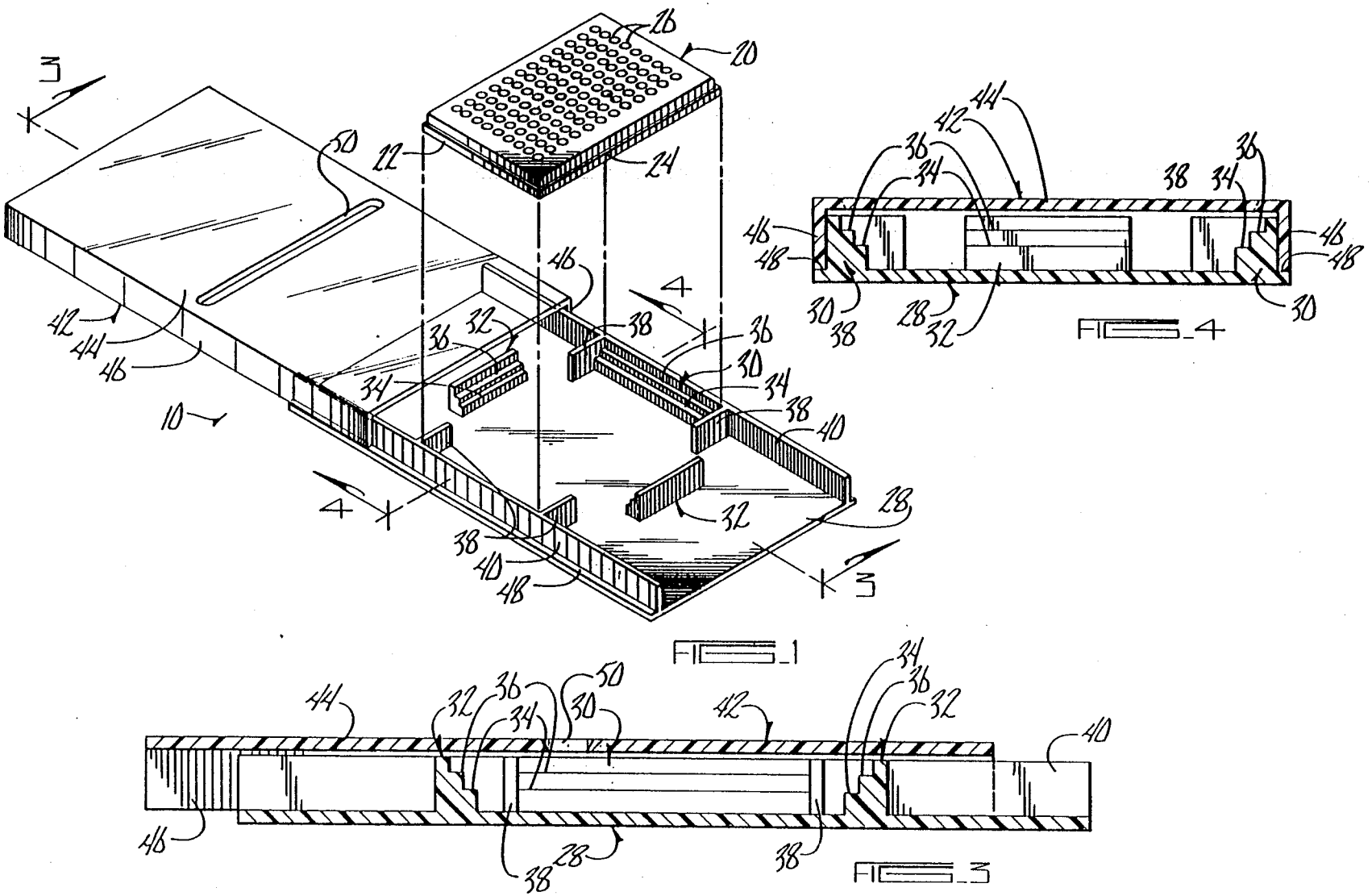
FIG. 1 is a perspective view of the first embodiment of the device of this invention with the microtiter plate elevated.
FIG. 2 is a top plan view of the first embodiment of this invention.
FIG. 3 is a cross-sectional view taken along line 3—3 of FIG. 1.
FIG. 4 is a cross-sectional view taken along line 4—4 of FIG. 1.

In FIG. 1, the indexing means of the first embodiment is represented at 10. It is designed to be used with a microtiter plate 20. The microtiter plate 20 is rectangular in shape, including two ends 22, and sides 24. Within the plate 20 is included rows (discussed in detail later) of holes called microwells 26.

The first embodiment of the invention consists of a base plate 28 having a first pair of supports 30 located on the base plate 28 opposite one another. A second pair of supports 32 are located on the base plate also opposite each other, and on an axis which is perpendicular to the axis of the first pair of supports 30. Microtiter plate 20 is supported by either first pair of supports 30, or second pair of supports 32 on the base plate 28.

In this preferred embodiment of the invention, both first pair of supports 30, and second pair of supports 32 consist of stepped ledges, including a bottom ledge 34 and a top ledge 36. It can be seen that these ledges are arranged like steps, resulting in the ability to support microtiter plates of different sizes in one base plate 28. It is possible that the first pair of supports 30 may have a bottom ledge 34 and a top ledge 36 which are different in dimensions in height and distance from each other than the bottom ledge 34 and top ledge 36 of the second pair of supports 32. This allows different sized plates to be separately supported. In this manner, a microtiter plate may be placed within the bottom of the base plate 28 abutting bottom ledge 34 of the first pair of supports 30, a different sized plate may be placed on top of the bottom ledge 34, and abutting the top ledge 36, or still a third different sized microtiter plate may be placed on top of top ledge 36. When the second pair of supports are of different dimensions from the first pair of supports, then it can be seen that an additional three different sizes of microtitration plates may be accommodated within one base plate 28. Therefore, it is possible that one base plate 28 will be capable of supporting six different sized microtitration plates. This is especially useful since a number of different sizes of titration plates are currently available upon the market. Thus, for example, if 24 different sized plates are to be accommodated, only four base plates need to be manufactured. This would reduce the cost in manufacture, and aid in storage of the base plates. More or less than three steps may be incorporated.

Alternatively, first pair of supports 30 may be the same distance from each other as second pair of supports 28. In that case, as can be seen in FIG. 2, a microtiter plate may be optionally supported either on the first pair of supports, as shown at position "A", or it may be rotated 90° and supported on the second pair of supports reflected at position "B". This allows access to the rows or columns on the rectangular shaped microtiter plate 20 on either its longitudinal axis or lateral of the longitudinal axis.

It also is preferred that on the first pair of supports 30, lateral sidewalls 38 are provided. These sidewalls 38 jut out from the sides of both first pair of supports 30 towards the interior of base plate 28. The sidewalls prevent longitudinal movement of the microtiter plate 20, while it rests on the first pair of supports 30. When a microtiter plate is placed on the second pair of supports, sidewalls 38 jut towards the center of the base plate 28 sufficiently to abut microtiter plate 20. This, then, prevents any lateral movement of the plate 20 while it is resting on second pair of supports 32.

Sidewalls 40 arise upward from base plate 28. Cover 42 is designed to slide along the sidewalls 40. The cover 42 consists of a top 44, sidewalls 46 which extend downwardly from the top 44, and the sidewalls of the cover 46 are a further distance from each other than sidewalls 40 of the base plate 28. In this manner, sidewalls 46 of the cover 42 are allowed to slide back and forth longitudinally along sidewalls 40 of the base plate 28. It is also preferred that a shoulder 48 be provided which extends laterally outward from base plate 28 and base plate sidewalls 40. This shoulder aids in sliding movement of cover 42 over the base plate 28.

The top 44 of cover 42 is provided with an opening 50. In this embodiment of the invention, opening 50 is an elongated narrow opening of a length sufficient to expose all of a row or column of microtiter plate 20 at the same time. By sliding cover 42 along the sidewalls 40 of base plate 28, an entire row of microwells 26 are exposed at one time, while the remaining microwells are protected beneath the cover 42. This reduces contamination from materials falling onto the microtiter plate from the air, while also preventing cross-contamination between one row of microwells to another. Further, it allows the lab technician to be able to keep track of which row is being pipetted. Of course, it is evident that opening 50 may take any of numerous sizes and shapes to simultaneously cover microwells while exposing others.

It is also possible to provide the cover 42 with symbols to aid in indexing, as more fully discussed in the description of the second embodiment.

By way of example in demonstrating the ability of this embodiment to adapt to various sized microtiter plates, a base plate 28 was constructed which had a first pair of supports 30 on base plate 28 which had bottom ledges 34, 4 ¾ inches from each other and ¼ inches thick. Top ledges 36 were located five inches from each other, and ⅛ inch thick. The inner side of base plate sidewalls 40 were a distance of 5 ⅛ inches from one another. Sidewalls 40 were approximately ¼ inch thick. Cover 42 had a transparent top 44 made of plastic with sidewalls of the cover 46 being 5 9/16 inches apart.

This example allows a microtiter plate manufactured by Pandex Laboratories, Inc., of Mundelein, Ill. to easily fit within the top ledge 36 of the first pair of supports. When second pair of supports 32 has the same dimensions as first pair of supports, the Pandex microtitration plate may be rotated to fit easily on this second pair of supports 32. Larger microtiter plates fit on the bottom edge.

A second embodiment is shown in FIGS. 5 through 11. FIGS. 5, 7, 8 and 9 show the sample support indexing means 52. The embodiment may be adapted to hold any type of sample supporter having multiple sample holders such as the microtiter plate 22. It includes a base plate 54, with side members, here depicted as sidewalls 56 arising opposite each other upward from the base plate 54. It is to be understood that only one side member may be necessary which can take several forms and may itself be capable of movement. It is designed to assist in indexing by providing a surface on which symbols for indexing may be supported. The preferred embodiment may include an end piece 58 connecting sidewalls 56, within which the sample support, in this case microtiter plate 22 rests, thereby preventing the plate from sliding out of the end of the base plate 54. Sidewalls 56 have a top surface 60 capable of supporting identifying matter. A guide member is also provided, here taking the form of a cover 62 which has a top 64, and sidewalls 66 opposite each other which descend down from the top 64. Again, sidewalls 66 are a further distance from one another than the sidewalls of the base plate 56 to allow the cover 62 to easily slide over base plate 54. Additionally, an end piece 68 may also be provided in top 64 having slots therein (not pictured) which allows guiding movement of cover 62 over base plate 54 and also serves as a stop. The top 64 is also capable of supporting printed matter.

When the sample supporter is a microtiter plate 22 it includes multiple sample holders which here are microwells arranged in columns 70, as more easily seen in FIG. 9, and rows represented at 72. Typically, there are eight rows 72, and twelve columns 70. In the preferred embodiment for use with microtiter plate 22, cover symbols are provided as represented at 74. Each of these symbols 74 is different from one another, and each is aligned with a column 70. Each separate symbol 74 is representative of a column 70. Top surface 60 of sidewalls 56 on base plate 54 also have symbols 76. Each of these symbols 76 are also different from one another, and each align with a row of microwells 72. Each base plate symbol 76 is representative of a row 72. Thus, it can be seen that by matching the cover symbol 74 aligned with a microwell in a column 70, and matching that microwell to the base plate symbol 76 on its row 72, each microwell has its own distinct combination of base plate symbol 76 and cover symbol 74. This indexing allows each microwell to be identified. For example, the microwell in the furthest upper lefthand corner of FIG. 9 is represented by cover symbol "1", and base plate symbol "A". Since the cover 62 may slide along the base plate sidewalls 56, ease in indexing is provided, as well as assisting the lab technician in immediately spotting which row has been pipetted, and which rows remain.

The second embodiment of this invention may also provide for another component part. This may be used with either the first or second embodiments. This component part is shown in FIGS. 6, 10 and 11 and incorporates the same features as the first component. It is designed to be used when a sample is being pipetted from a distinct identified source into a second distinct sample holder or microwell. It provides for a source indexing means 78 also consisting of vertical side member shown here in the preferred embodiment as sidewalls 80 which have a top surface 82 capable of supporting printed material. A joining member 84 connects the vertical sidewalls 80 to one another. Sample racks 85 are conventionally provided which include wire racks, or blocks, such as shown, which hold numerous samples or test tubes 83 within them. Indexing means 78 may be adapted to accommodate any one of the various sample racks 85 which are available.

A guide member 86 extends over sample rack 85, and may take any number of sizes and shapes. In this embodiment, it is represented as an elongated flat member 88 having a top surface 90, which is also capable of supporting identifying matter. A side member 92 extends on either side of elongated flat member 88 downward toward vertical sidewalls 80, and a protruding section 94 is adapted to fit into a slot 96 located on vertical sidewalls 80. Thus, guide member 86 may easily slide back and forth along top surface 82 of vertical sidewalls 80. A window 98 may also be provided, further aiding the lab technician in visually observing the printed matter on top surface 82 of vertical sidewalls 80.

As with the microwells of microtitration plate 22, the test tubes 83 of sample rack 85 are arranged in columns 100, and rows 102. Symbols 104 on top surface 90 of guide member 86 are also different from one another, and aligned with columns 100. Each guide symbol 104 is representative of a column 100. Symbols 106 on the top surface 82 of vertical sidewalls 80 are provided which are different from one another, with each symbol aligned with a row 102, and representative of the row 102. An indexing means is used similar to that used for microtiter indexing means 52, where the symbol 104 on guide member 86 may be indexed to sidewall symbol 106 to particularly identify any one of the samples in sample rack 85.

When symbols 106 of source indexing means 78 match base plate symbol 76 of microtiter plate indexing means 52, and further guide symbols 104 of source indexing means 78 match cover symbol 74 of microtiter plate indexing means 52, then it can be seen that any one of the test tubes 83 in sample rack 85 may be identified and matched with its corresponding microwell 26 in microtiter plate 22. Thus, a test tube 83 in rack 85 may be matching with its corresponding microwell 26. It is to be understood that the above embodiments are only examples of the invention, and that variations may occur and still fall within the spirit and scope of the invention.

Thus, it can be seen that the invention accomplishes at least all of its objectives.

What is claimed is:

1. An indexing means for a sample container having multiple sample holders comprising:

a cover having a top and two opposite sidewalls extending downwardly from the top;

said cover sidewalls of a distance opposite one another to allow said cover to slide over a sample container having multiple sample holders;

a base plate having first and second sidewalls of a distance opposite one another narrower than the distance between said cover sidewalls, said second sidewalls wider than said sample container and allowing said cover to slide along said second sidewalls;

a pair of supports located on said base plate opposite each other, said supports of a height and distance from one another to support said sample container;

said supports having multiple stepped ledges so that said sample containers of various sizes can be supported;

an opening within said top allowing access to at least a portion of said sample holders when said cover is placed over said sample container, so that said cover may slide back and forth over said sample container allowing selective covering of a portion of said sample holders while allowing access to another portion of said sample holders.

2. The indexing means of claim 1 further comprising a second pair of supports located on said base plate opposite each other on a longitudinal axis, said first pair of supports located lateral of said longitudinal axis.

3. The indexing means of claim 2 wherein said first pair of supports are the same distance from one another as the distance between said second pair of supports.

4. The indexing means of claim 3 wherein each of said first pair of supports has two sides and a side wall located on each side of said support to prevent lateral movement of said sample containers.

5. The indexing means of claim 4 wherein said sidewalls of said first pair of supports extend sufficiently inward on said base plate so that said sidewalls abut said sample container when said container is positioned on said second pair of supports, thereby preventing lateral movement of said sample container.

* * * * *